US008668056B2

(12) United States Patent
Loiselet et al.

(10) Patent No.: US 8,668,056 B2
(45) Date of Patent: Mar. 11, 2014

(54) MODULAR WEIGHTING ELEMENTS

(75) Inventors: Sylvain Loiselet, Chartres (FR); Sebastien Loiselet, Gironville (FR); Jean-Sebastien Couilleau, Elancourt (FR)

(73) Assignee: Loiselet, S.A.R.L., Nogent le Roi (FR)

( * ) Notice: Subject to any disclaimer, the term of this patent is extended or adjusted under 35 U.S.C. 154(b) by 270 days.

(21) Appl. No.: 13/132,437

(22) PCT Filed: Dec. 3, 2009

(86) PCT No.: PCT/FR2009/001370

§ 371 (c)(1),
(2), (4) Date: Jun. 2, 2011

(87) PCT Pub. No.: WO2010/063905

PCT Pub. Date: Jun. 10, 2010

(65) Prior Publication Data

US 2011/0240415 A1 Oct. 6, 2011

(30) Foreign Application Priority Data

Dec. 3, 2008 (FR) ..... 08 06772

(51) Int. Cl.
*B66B 17/12* (2006.01)

(52) U.S. Cl.
USPC ..... 187/404

(58) Field of Classification Search
CPC ..... B66B 17/12
USPC ..... 187/404
See application file for complete search history.

(56) References Cited

U.S. PATENT DOCUMENTS 729,366 A1 11/2007 Brossart et al.
2004/0094371 A1 5/2004 Augugliaro
2007/0246307 A1* 10/2007 Cloux et al. ..... 187/404
2009/0129907 A1* 5/2009 Huang ..... 414/673
2012/0317906 A1* 12/2012 Hammond ..... 52/223.7

FOREIGN PATENT DOCUMENTS

| | | |
|---|---|---|
| CN | 101077753 | 11/2007 |
| WO | WO9207787 | 5/1992 |
| WO | WO2006035257 | 4/2006 |
| WO | WO 2007141398 A1 * | 12/2007 |
| WO | WO2007144454 | 12/2007 |
| WO | WO2008022540 | 2/2008 |

OTHER PUBLICATIONS

English Machine Translation of WO 2007/141398 A1.*
Opinion ecrit sur le brevetable d'invention, circa Dec. 3, 2008, issued in connection with priority application (FR08/06772) by French Patent Office.
Jun. 16, 2011, English translation of Written Opinion for PCT/FR2009/001370.

* cited by examiner

*Primary Examiner* — William E Dondero
*Assistant Examiner* — Diem Tran

(57) ABSTRACT

The invention relates to a modular weighting element that can be assembled with at least one other modular element to form a ballast bar, known as an ingot, for example for creating a counterweight for a lift/elevator and/or goods lift, said modular element being in the form of a generally parallelepiped elongate body. According to the invention, said modular element comprises at least two assembly members, one of them male and the other female, of complementary shapes, arranged on said body in such a way as to allow said modular element to be assembled with at least one other modular element, preferably an identical one aligned in the continuation of one another. The invention also relates to a ballast bar, to a counterweight by superposing such ballast bars and to an assembly comprising the framework carrying such a counterweight.

13 Claims, 2 Drawing Sheets

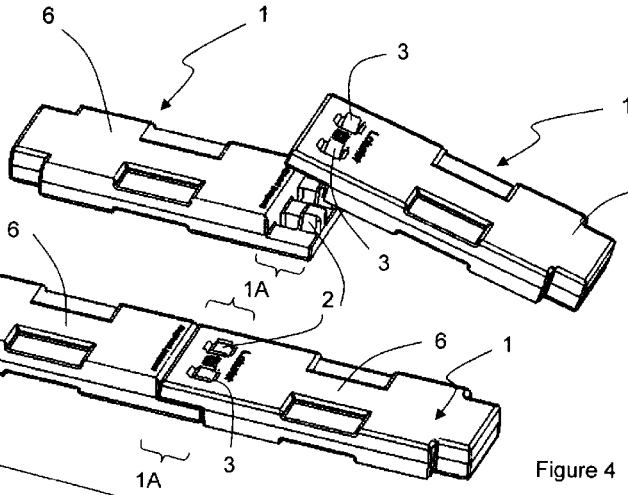
Figure 3
Figure 4
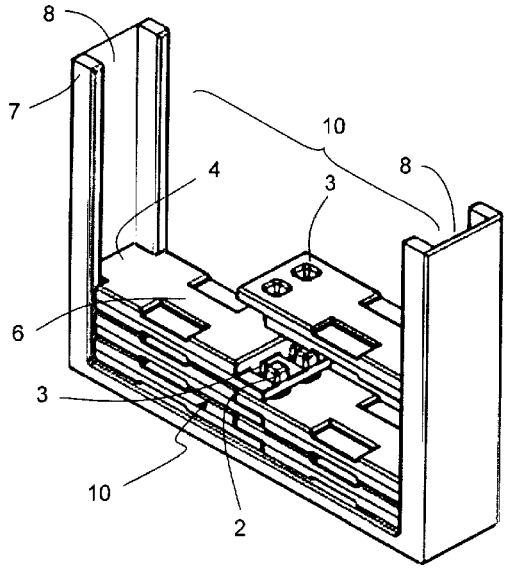
Figure 5

MODULAR WEIGHTING ELEMENTS

The present invention generally relates to modular weighting elements.

The invention more specifically relates to one modular weighting element to be assembled to one or more additional modular element(s) in order to form a ballast bar, known as an ingot, to create, for example, an elevator counterweight system, said modular element being in the form of a generally parallelepipedal elongate body. Furthermore, this invention relates to a ballast bar arrangement, a counterweight system obtained by stacking said bar element on top on another bar and an assembly consisting of an understructure (frame) supporting such counterweight system.

Generally a counterweighted elevator or load elevator is powered by an electric motor when moving and said elevator is linked to a counterweight system using a plurality of pulleys. Said counterweight system compensates the weight of the elevator and thus decreases the energy required from the motor to drive in motion said elevator.

The process used in a system of two modular elements assembled together by a longitudinal edge to form ballast bar assemblies that are stacked one on top of another one in such a way to create such a counterweight system for the elevator is known. However, the modular elements constituting the bar assemblies can sometimes be distorted as a result of buckling caused by manufacturing defects on bars of critical lengths. In fact, the longer the modular elements are, the greater is the risk of deformation. The side of a bar stacked on another one is no longer flat, generating a mismatch in the movement of the upper bar against the lower when the counterweight system is vertically moving due to the drive from the elevator. This produces vibrations of the bars against each other and causes a high level of rattling noise.

Moreover, such modular elements to be assembled by a longitudinal edge are difficult to manufacture by an automated molding process and/or a molding machine due to the critical length of the bars. In fact, in that case a mold of the length of the bar is required, thus generating significant manufacturing costs.

The present invention is intended to disclose a modular weighting element arrangement for which the risk of deformation, especially from buckling, is reduced.

Another purpose of this invention is to disclose a modular weighting element assembly that can be automatedly manufactured and at lower costs using a molding method.

Another purpose of this invention is to allow the production of a ballast bar arrangement and/or a counterweight system using only one kind of modular element, being easy to manipulate and easy to assemble to another identical element.

Another purpose of this invention is to disclose a counterweight system, especially designed for an elevator, wherein vibrations from modular elements are reduced.

For these reasons, this invention relates to a modular weighting element assembly to be assembled to one or more modular element(s) in order to obtain a ballast bar, known as an ingot, to create, for example, an elevator and/or load elevator counterweight system, said modular element being in the form of a generally parallelepipedal elongate body, wherein said modular element, a hermaphrodite type, is composed with one or more assembly parts, one male and one female of complementary shapes, said assembly parts being arranged on said body in order to allow an assembly of said modular element with one or more additional modular element(s), preferably an identical one aligned in the continuation of one another, by cooperation of at least the male part, or respectively the female, of said element with the female part, or respectively the female, of said adjacent additional modular element.

Such a design of said modular element equipped with assembly means allows the assemblage of any modular elements in a end-to-end arrangement in order to recreate said bar. Said bar can especially be recreated from two elements of a length close to half the length of the bar, generally slightly longer than the half length of said bar to obtain a joint preferably interlocking when said elements are slip jointing with each other.

The length of modular elements is then reduced to the state-of-the-art elements which were assembled by a longitudinal edge in a two-by-two configuration. The reduction of length decreases the buckling phenomena of the element. As a result, the bars obtained undergo less deformation. The bars stacked one on top of another to constitute the counterweight system remain then in contact with each other without any clanking. The vibrations from bar movement are then reduced when the elevator is in motion.

Moreover, the design of modular elements with a reduced length allows the use of reduced length molds compared to the molds in the prior art, which reduces manufacturing costs of said modular elements.

Due to the complementary shapes of male and female parts arranged on one modular element, such a modular element can be assembled to any other identical modular element. Designing one kind of modular element is thus sufficient to reconstitute each bar by assembling such elements end-to-end.

Said assembly parts, male and female, are advantageously arranged at, or in close proximity to, the same said body end, known as the assembly end.

The end-to-end assembly of two elements is performed by cooperation of at least the male part, respectively female, of said element with the male part, respectively male of said other adjacent, identical modular element.

The presence of two assembly parts within the assembly area of a modular element with another identical modular element prevents the rotation of the elements between one another when assembled.

The arrangement of assembly parts at one end of the element body facilitates its assembly to another element and allows the reduction of length of said element required for the reconstitution of the bar by assembling an end-to-end plurality of elements.

The locations of at least two assembly parts define a straight line, preferably perpendicular to the longitudinal orientation of said element.

The invention assembly parts of said element are advantageously designed for efficient assembly or disassembly from the top two modular elements, preferably identical ones.

In this case, the preferable connection is the interlocking of the two ends of said elements. This assembly is preferably a halving joint type assembly, each element being bent at angle at the proximity of its end to half close this end part.

Said invention element is advantageously equipped with two male parts and two female parts of complementary shapes, preferably located at, or close to the same end of said body, known as the assembly end.

The invention male part, or each male part, is advantageously equipped with a lug and the invention female part is advantageously equipped with an orifice through the upper and lower faces of said element.

One or more of said lugs of the invention are advantageously supported by at least one of the element ends, one or more said lugs being obtained within the body thickness over a height preferably corresponding to the half thickness of said element body extending according a orthogonal orientation to the longitudinal orientation of said element, and wherein one or more of the through orifices is arranged within the remaining height of said end part of the element accomodating the lugs.

The length of said element of the invention is advantageously lower than 650 mm.

The thickness of said element of the invention is advantageously between 20 and 100 mm, preferably between 24 and 95 mm.

Said element of the invention is advantageously composed of cast iron.

Additionally, this invention relates to a counterweight system created by stacking a plurality of ballast bars, known as ingots, constituted of a counterweight assembly and a chassis supporting said counterweights, said chassis being composed with a frame where each post is constituted with a groove placed inwards toward the frame, forming the entry rail of the counterweight elements, wherein the said counterweight element is as previously described and wherein each modular element end, at the opposite side of its assembly area with another preferably identical element, presents a section constituting the tenon permitting to slide in the groove of one of the chassis supports and allowing said modular element to be rail guided inside said groove.

Additionally, this invention relates to a modular weighting element to be assembled to one or more preferably similar additional modular element(s) to form a bar, known as ingot, to create, for example, an elevator and/or load elevator counterweight system, said modular element being in the form of a generally parallelepipedal elongate body, wherein said modular element is composed with male and/or female type complementary assembly means arranged on another modular element in order to create an assembly of two modular elements in an aligned configuration.

Finally, this invention relates to a ballast bar obtained after connecting at least two elements end-to-end as previously described.

As a alternative embodiment, a ballast bar may be formed by assembling at least two identical elements constituting the ends of the bar, said two elements identical being connected to each other by one or several additional end elements.

BRIEF DESCRIPTION OF THE DRAWINGS

This invention will be fully understood after reading the following description of exemplary embodiments in reference to the appended drawings, in which:

FIG. 3 is a view of the two modular elements of FIG. 2 before assembly;

FIG. 4 is a view of the two elements of FIG. 3 assembled and forming a ballast bar;

FIG. 5 is a view of the chassis inside which are inserted the modular elements according to the invention design to form a stacking of ballast bars.

Figure 1:
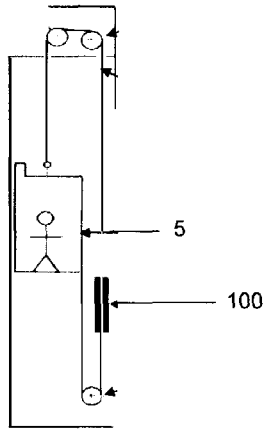
FIG. 1 is a schematic view of an elevator equipped with a counterweight.

In reference to Figures and as reported hereabove, this invention relates to a modular weighting element 1 intended to be assembled to at least another modular element to create a ballast bar 10, known as an ingot or pig ingot. According to one prefered embodiment, as illustrated in FIGS. 1 & 5, said bars are stacked one to another constitute the counterweight 100 for an elevator 5. Said modular element 1 is in the form of a generally parallelepipedal elongate body 6. Preferably, said element is made of cast iron and obtained after molding. The production of an element in cast iron allows to obtain modular elements having a high specific mass and thus to offset the load of the counterweight formed using said elements. In another embodiment, said element may be composed of another material, such as steel or concrete, for example.

Figure 2:
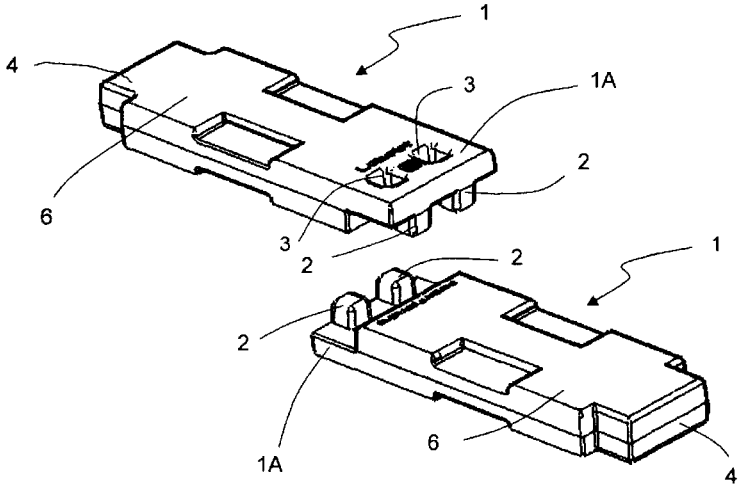
FIG. 2 is a perspective view of two modular elements to be assembled according to the invention; the assembly parts of an element being arranged in relation to the assembly parts of another element.

One of the aspects of the invention, as illustrated in FIG. 2, is that the modular element 1, known as hermaphrodite, is composed with at least two assembly parts, one male 2 and one female 3 of complementary shapes. Said assembly parts 2, 3 are arranged on said body 6 in order to permit an assembly of said modular element 1 with at least another identical modular element 1 aligned in the continuation of each other (FIGS. 3 & 4). Said end-to-end assembly is obtained by cooperation of at least the male part, or respectively female, of said element with the female part, or respectively male, of said other identical adjacent modular element.

Most preferably, said assembly parts, male 2 and female 3, are arranged at, or close to, a same end of said body, known as assembly end 1A. The assembly parts 2 & 3 of said element are designed to allow assembly and/or disassembly from the top of two identical modular elements 1.

As the example illustrated in the figures, said modular element is equipped with two male parts 2 and two female parts 3 of complementary shapes located at, or close to, the assembly end 1A of said body.

Each male part 2 is composed with a lug and each female part 3 presents an orifice through the upper and lower faces, known as top and bottom faces of said modular element 1.

Each lug 2 is obtained within half-thickness of the body 6 of said element 1 extending according to a orthogonal orientation to the longitudinal orientation of said element, and wherein one or more of the through openings is arranged within the remaining height of said end part of the element accomodating the lugs. Each through opening is contained within the remaining half-thickness of the end part of the element accomodating the lugs 2. These half-thicknesses are arranged at one end of said body, beyond the shoulder of said body.

Such design of the lugs and through openings allows a tumbled assembly, half joint-type, of two modular elements. One of the two elements is thus reversed and reverted. The assembly end of the reverted element may then be connected from the top to the matching end of the non-reverted element, so that each male part of an element can slide in the corresponding female part of the other element (FIGS. 3 & 4).

Additionally, the presence of through openings allows each modular element to be easily suspended, thus facilitating shot-blasting operations. In another embodiment, at least one of each female part is constituted by a blind orifice.

A dovetail-type assembly can also be considered. In this case, the modular element presents a dovetail wedged tenon and a cutout of complementary shapes forming a mortise.

The length of the modular element is less than 650 mm. A length less than 650 mm greatly reduces the risks of buckling of said elements and allows them to be manufactured according to automated manufacturing processes.

The thickness of said element is between 20 and 100 mm, preferably between 24 and 95 mm. Most preferably, the thickness of each element is doubled relatively to the prior art, which allows the production of a counterweight system with a number of ingots identical to the one from the prior art, thus preventing the number of manipulations to be increased.

The weight of said element is advantageously between 10 and several tens of kilograms, for example 25 kg.

As previously indicated, each ballast bar, or ingot, may be stacked on top of another bar to create the counterweight for the elevator.

As illustrated by the example in FIGS. 1 & 5, said counterweight for elevators is accomodated inside a chassis 7. Said chassis 7 is composed of a frame where each post presents a groove 8 open inwards toward the frame and forming the entry rail of the counterweight elements.

The end of each modular element 1, at the opposite side of its end-to-end assembly area with another identical element, presents an element 4 forming the sliding tenon in a groove 8 of one of the posts of the chassis 7. This element 4 allows the guidance of said modular element 1 in said groove 8.

As illustrated in FIG. 5, the design of each bar in the form of modular elements to be assembled together allows each modular element to slide easily in the chassis by laterally sliding the guiding part 4 or tenon of said element in the groove 8 of the corresponding support. In fact, such side sliding is permitted because the width of the frame is fairly equal to the width of a bar, therefore significantly greater than the width of one modular element. It is thus possible to stack the modular elements one on top of the other one inside the chassis. The modular element introduced along the groove of a post is slotted together from the top with the modular element located at the same level and introduced into the groove of the opposite post.

As an example, for a 1 160×120 mm frame, and for filling the gap, 40 modular elements will be used, each having an approximate height of 610 mm, an approximate thickness of 50 mm and an approximate width of 120 mm, so the resulting weight of one element is within the range of 1,000 kilograms.

The present invention is not limited to the embodiments decribed and represented therein, but those skilled in the art will be able to add further variances according to their knowledge.

The invention claimed is:

1. A modular weighting element to be combined with another modular element to form a ballast bar having an overall length, the modular weighting element comprising:

a generally parallelepiped body having a length that is smaller than the overall length; and a first assembly part and a second assembly part of complementary shape, the first and second assembly parts being arranged on the body in a plane substantially parallel to the length in order to allow an assembly of said modular weighting element with reciprocal second and first assembly parts, respectively, of the other modular element, to thereby combine the length of said modular weighting element with a length of the other modular weighting element to extend their respective lengths and to form the ballast bar;

where the ballast bar is adapted for stacking on top of other ballast bars along a dimension substantially orthogonal to the length to form an aggregate weight element, the generally parallelepiped body defines at least one long edge parallel to a longitudinal axis of the body, and at least one short edge along the dimension substantially orthogonal to the longitudinal axis, the first assembly part comprises at least two joint structures to engage with reciprocal structures of the at least one other modular element, and the first assembly part is oriented on the body in a manner so as to inhibit relative movement of the other modular element along the dimension.

2. The modular weighting element of claim 1, where at least one of the first assembly part or the second assembly part comprises a first joint member for interlocking engagement with a second joint member of the at least one other modular element.

3. The modular weighting element of claim 2, where the first joint member includes a mortise, where the second joint member includes a tenon, the mortise to engage the tenon.

4. The modular weighting element of claim 1, where the first assembly part includes a male part and said second assembly part includes a female part, the male and female parts to engage with respective, complementary female and male parts of the at least one other modular element.

5. The modular weighting element of claim 1, where the first assembly part includes plural male parts and said second assembly part includes plural female part, each of the male and female parts to engage with respective, complementary female and male parts of exactly one other modular element.

6. The modular weighting element of claim 1, where:

the other modular element comprises an instance of said modular weighting element; and said modular weighting element thereby forms a unisex combinatorial element adapted to form the ballast bar through lengthwise combination with another of said modular weighting element.

7. The modular weighting element of claim 1 where the at least two joint structures each comprise a lug, and where the reciprocal structures comprise orifices, the at least two lugs sized and positioned to simultaneously engage the orifices of the other modular element in mating relationship.

8. The modular weighting element of claim 7, where each orifice has a depth at least approximately one-half a maximum thickness of the generally parallelepiped body.

9. The modular weighting element of claim 1, consisting substantially of one or more of cast iron, iron, concrete or steel.

10. The modular weighting element of claim 1, consisting substantially of cast iron.

11. The modular weighting element of claim 1, where the other modular element is substantially identical to the modular weighting element, and where the modular weighting element has a longitudinal edge and a short edge, the modular weighting element to engage the other modular element along their respective short edges, in a manner such that their respective longitudinal edges lie substantially in a single plane.

12. The modular weighting element of claim 1, where:

the ballast bar is adapted to form the aggregate weighing element by engaging a chassis of the aggregate weighting element; and the modular weighting element has a first edge and a second edge, the modular weighting element to engage the other modular element along the first edge, the generally parallelepiped body also defining along the second edge a sliding tenon to engage a groove of the chassis.

13. The modular weighting element of claim 1, where the first and second assembly parts are to inhibit relative rotation between the modular weighting element and the other modular element when assembled together.

* * * * *